US010711728B2

(12) United States Patent
Shimizu

(10) Patent No.: US 10,711,728 B2
(45) Date of Patent: Jul. 14, 2020

(54) CONTROL DEVICE FOR INTERNAL COMBUSTION ENGINE

(71) Applicant: TOYOTA JIDOSHA KABUSHIKI KAISHA, Toyota-shi (JP)

(72) Inventor: Hajime Shimizu, Gotemba (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/371,256

(22) Filed: Apr. 1, 2019

(65) Prior Publication Data

US 2019/0301391 A1 Oct. 3, 2019

(30) Foreign Application Priority Data

Apr. 3, 2018 (JP) ..... 2018-071626

(51) Int. Cl.

| | |
|---|---|
| ***F02D 41/30*** | (2006.01) |
| ***F02D 41/40*** | (2006.01) |
| ***F02P 5/04*** | (2006.01) |
| ***F02P 5/153*** | (2006.01) |
| ***F02D 35/02*** | (2006.01) |

(Continued)

(52) U.S. Cl.

CPC ..... *F02D 41/402* (2013.01); *F02D 35/028* (2013.01); *F02D 41/3035* (2013.01); *F02P 5/045* (2013.01); *F02P 5/153* (2013.01); *F02B 1/12* (2013.01); *F02D 2041/389* (2013.01);

(Continued)

(58) Field of Classification Search

CPC .... F02D 41/402; F02D 41/3035; F02D 41/40; F02D 35/028; F02D 2200/0614; F02D 2200/024; F02D 2041/389; F02P 5/153; F02P 5/045; F02B 1/12

USPC ..... 123/299, 300, 305, 435, 406.22, 406.41, 123/406.42, 406.43, 406.47; 701/103–105; 73/114.16, 114.17

See application file for complete search history.

(56) References Cited

U.S. PATENT DOCUMENTS

2008/0243358 A1 10/2008 Kojima et al.
2016/0341135 A1 11/2016 Shirahashi et al.

(Continued)

FOREIGN PATENT DOCUMENTS

EP 2 541 030 A1 1/2013
JP 2008-274927 A 11/2008

(Continued)

*Primary Examiner* — Hai H Huynh

(74) *Attorney, Agent, or Firm* — Oblon, McClelland, Maier & Neustadt, L.L.P.

(57) ABSTRACT

A control device for an internal combustion engine provided with a combustion control part successively performing at least first main fuel injection and second main fuel injection for causing premix charged compression ignition of fuel so that a pressure waveform showing a change of a rate of cylinder pressure rise over time becomes a two-peak shape and a peak ratio which is a ratio of a first peak value of a first peak of the pressure waveform and a second peak value of a second peak falls within a predetermined range. The combustion control part calculates the ignition delay time of the fuel injected by the second main fuel injection (second ignition delay time) and reflects the injection correction amount in the target injection amount of the second main fuel injection (second target injection amount) if an injection correction amount is set for the amount of fuel injected from the fuel injector and the second ignition delay time is less than a predetermined value.

3 Claims, 7 Drawing Sheets

(51) Int. Cl.
*F02D 41/38* (2006.01)
*F02B 1/12* (2006.01)

(52) U.S. Cl.
CPC ..... *F02D 2200/024* (2013.01); *F02D 2200/0614* (2013.01)

(56) References Cited

U.S. PATENT DOCUMENTS

| | | | |
|---|---|---|---|
| 2017/0184047 | A1 | 6/2017 | Shirahashi et al. |
| 2017/0234249 | A1 | 8/2017 | Sakai |

FOREIGN PATENT DOCUMENTS

| | | |
|---|---|---|
| JP | 2015-78617 | 4/2015 |
| JP | 2016-217215 | 12/2016 |
| JP | 2017-145696 | 8/2017 |

CONTROL DEVICE FOR INTERNAL COMBUSTION ENGINE

CROSS-REFERENCE TO RELATED APPLICATION

This application claims priority based on Japanese Patent Application No. 2018-071626 filed with the Japan Patent Office on Apr. 3, 2018, the entire contents of which are incorporated into the present specification by reference.

FIELD

The present disclosure relates to a control device for an internal combustion engine.

BACKGROUND

Japanese Unexamined Patent Publication No. 2015-078617 discloses a conventional control device for an internal combustion engine which performs main fuel injection split into a first main fuel injection and a second main fuel injection for premix charged compression ignition (PCCI) so that a combustion waveform (heat generation rate pattern) showing a change of a heat generation rate over time becomes a two-peak shape. This conventional control device for an internal combustion engine was configured to perform pre-injection when a temperature of an engine body (cooling water temperature) was lower than a reference temperature and further, when performing pre-injection, to reduce the amount of injection of the second main fuel injection by exactly the amount of injection of the pre-injection at the time of a low engine load and to reduce the amount of injection of the first main fuel injection by exactly the amount of injection of the pre-injection at the time of a high engine load.

SUMMARY

However, the shape of the combustion waveform showing the change in the heat generation rate over time changes in accordance with the ignition delay times of the parts of the fuel injected by the first main fuel injection and the second main fuel injection. For this reason, if setting the target injection amounts of the first main fuel injection and the second main fuel injection so that the shapes of the combustion waveform showing the change in the heat generation rate over time and in turn a pressure waveform showing the change in the rate of cylinder pressure rise over time (cylinder pressure rise rate pattern) become the desired shapes, if ending up correcting the target injection amounts without considering the ignition delay times, it is liable to become no longer possible to maintain the shape of the pressure waveform showing the change in the rate of cylinder pressure rise over time at the desired shape.

The present disclosure was made in consideration of these problems and has as its object to maintain a shape of a pressure waveform showing a change in a rate of cylinder pressure rise over time at a desired shape if performing first main fuel injection and second main fuel injection for premix charged compression ignition even if an amount of correction is set for the amount of fuel injected from a fuel injector.

To solve the above problem, according to one aspect of the present disclosure, there is provided a control device for an internal combustion. The internal combustion comprises an engine body and a fuel injector injecting fuel for combustion inside a combustion chamber of the engine body. The control device comprises a combustion control part successively performing at least first main fuel injection and second main fuel injection to cause premix charged compression ignition of the fuel so as to cause heat generation two times in stages inside the combustion chamber so that a pressure waveform showing a change of a rate of cylinder pressure rise over time becomes a two-peak shape and so that a peak ratio which is a ratio of a first peak value of a first peak of the pressure waveform formed by a first heat generation and a second peak value of a second peak of the pressure waveform formed by a second heat generation falls within a predetermined range. The combustion control part comprises a second ignition delay time calculating part calculating a second ignition delay time which is an estimated value of an ignition delay time of fuel injected by the second main fuel injection and is configured so that if an injection correction amount for an amount of fuel injected from the fuel injector is set, when the second ignition delay time is less than a predetermined value, the injection correction amount is applied to a second target injection amount of a target injection amount of the second main fuel injection.

According to this aspect of the present disclosure, if performing first main fuel injection and second main fuel injection for premix charged compression ignition, even if a correction amount is set for the amount of fuel injected from the fuel injector, when the second ignition delay time is less than a predetermined value, the injection correction amount is applied to the second target injection amount and therefore the shape of the pressure waveform showing the change in the rate of cylinder pressure rise over time can be maintained at a desired shape.

DESCRIPTION OF EMBODIMENTS

Figure 1:
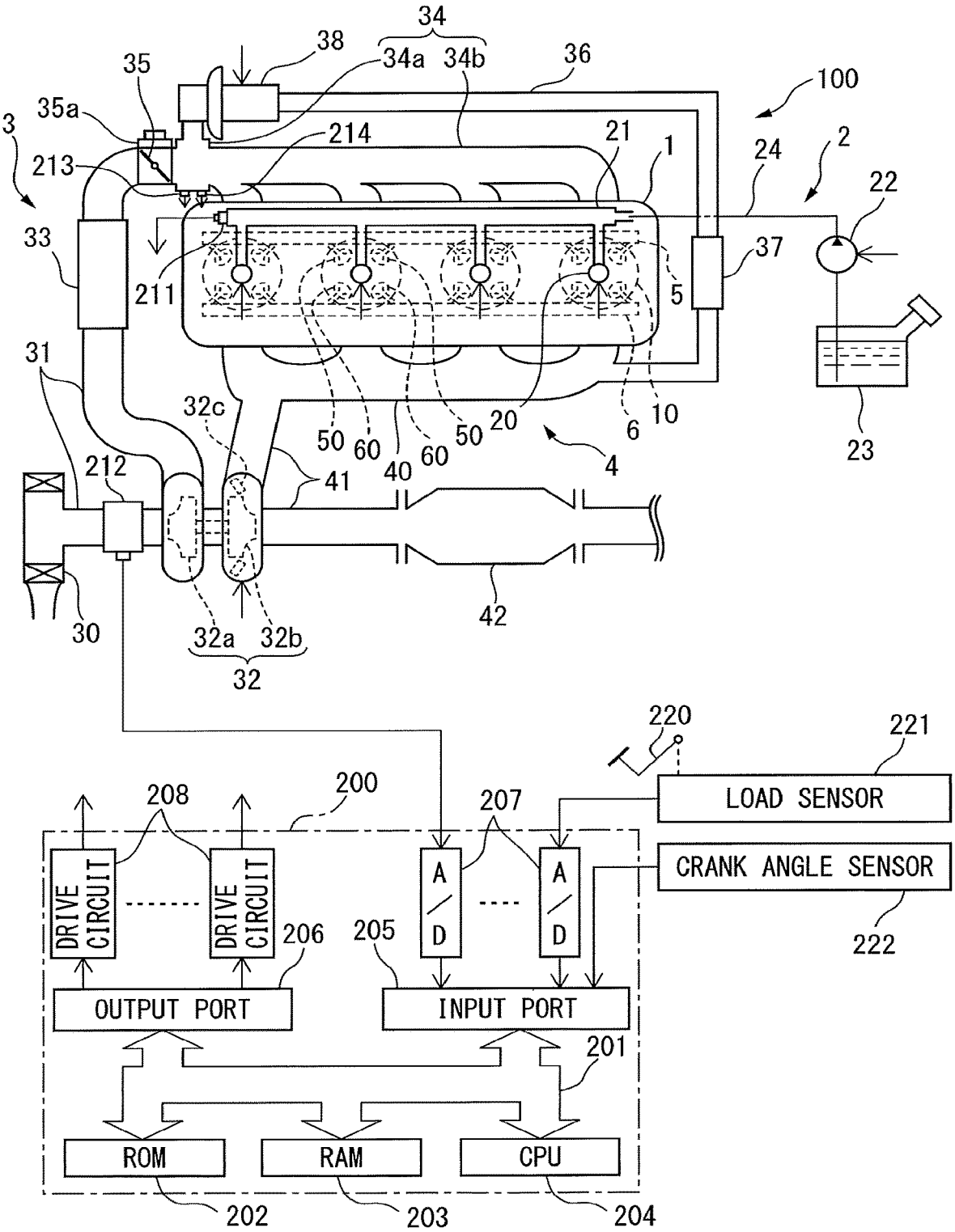
FIG. 1 is a schematic view of the configuration of an internal combustion engine and an electronic control unit for controlling an internal combustion engine according to one embodiment of the present disclosure.

Below, referring to the drawings, embodiments of the present disclosure will be explained in detail. Note that, in the following explanation, similar component elements will be assigned the same reference numerals.

Figure 2:
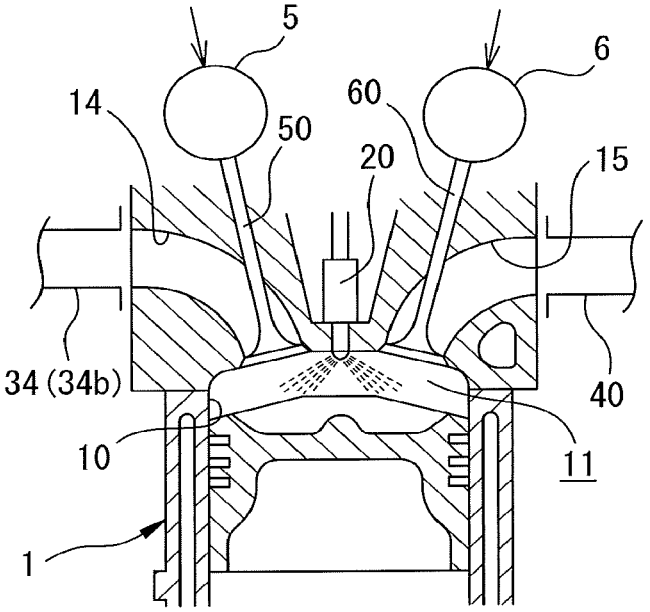
FIG. 2 is a cross-sectional view of an engine body of an internal combustion engine according to one embodiment of the present disclosure.

FIG. 1 is a schematic view of the configuration of an internal combustion engine 100 according to one embodiment of the present disclosure and an electronic control unit 200 controlling the internal combustion engine 100. FIG. 2 is a cross-sectional view of an engine body 1 of the internal combustion engine 100.

As shown in FIG. 1, the internal combustion engine 100 is provided with an engine body 1 provided with a plurality of cylinders 10, a fuel supply system 2, an intake system 3, an exhaust system 4, an intake valve operating system 5, and an exhaust valve operating system 6.

The engine body 1 makes fuel burn in combustion chambers 11 formed in the cylinders 10 (see FIG. 2) to for example generate power for driving a vehicle etc. The engine body 1 is provided with a pair of intake valves 50 and a pair of exhaust valves 60 for each cylinder.

The fuel supply system 2 is provided with electronic control type fuel injectors 20, a delivery pipe 21, supply pump 22, fuel tank 23, pumping pipe 24, and fuel pressure sensor 211.

One fuel injector 20 is provided at each cylinder 10 so as to face a combustion chamber 11 of the cylinder 10 so as to enable fuel to be directly injected into the combustion chamber 11. The opening time (injection amount) and opening timing (injection timing) of the fuel injector 20 are changed by control signals from the electronic control unit 200. If a fuel injector 20 is operated, fuel is directly injected from the fuel injector 20 to the inside of the combustion chamber 11.

The delivery pipe 21 is connected through the pumping pipe 24 to the fuel tank 23. In the middle of the pumping pipe 24, a supply pump 22 is provided for pressurizing the fuel stored in the fuel tank 23 and supplying it to the delivery pipe 21. The delivery pipe 21 temporarily stores the high pressure fuel pumped from the supply pump 22. If a fuel injector 20 is operated, the high pressure fuel stored in the delivery pipe 21 is directly injected from the fuel injector 20 to the inside of a combustion chamber 11.

The supply pump 22 is configured to be able to change the discharge amount. The discharge amount of the supply pump 22 is changed by a control signal from the electronic control unit 200. By controlling the discharge amount of the supply pump 22, the fuel pressure inside the delivery pipe 21, that is, the injection pressure of the fuel injector 20, is controlled.

A fuel pressure sensor 211 is provided in the delivery pipe 21. The fuel pressure sensor 211 detects the fuel pressure inside the delivery pipe 21, that is, the pressure of the fuel injected from the fuel injectors 20 to the insides of the cylinders 10 (injection pressure).

The intake system 3 is a system for guiding air to the insides of the combustion chambers 11 and is configured to enable change of the state of air taken into the combustion chambers 11 (intake pressure (supercharging pressure), intake temperature, and amount of EGR (exhaust gas recirculation) gas). That is, the intake system 3 is configured to be able to change the oxygen density inside the combustion chambers 11. The intake system 3 is provided with an air cleaner 30, intake pipe 31, compressor 32*a* of a turbocharger 32, intercooler 33, intake manifold 34, electronic control type throttle valve 35, air flow meter 212, EGR passage 36, EGR cooler 37, and EGR valve 38.

The air cleaner 30 removes sand and other foreign matter contained in the air.

The intake pipe 31 is coupled at one end to an air cleaner 30 and is coupled at the other end to a surge tank 34*a* of the intake manifold 34.

The turbocharger 32 is a type of supercharger. It uses the energy of the exhaust to forcibly compress the air and supplies the compressed air to the combustion chambers 11. Due to this, the charging efficiency is enhanced, so the engine output increases. The compressor 32*a* is a part forming a portion of the turbocharger 32 and is provided at the intake pipe 31. The compressor 32*a* is turned by a turbine 32*b* of the later explained turbocharger 32 provided coaxially with it and forcibly compresses the air. Note that instead of the turbocharger 32, it is also possible to use a supercharger mechanically driven utilizing the rotational force of a crankshaft (not shown).

The intercooler 33 is provided downstream from the compressor 32*a* in the intake pipe 31 and cools the air which was compressed by a compressor 32*a* and thereby became high in temperature.

The intake manifold 34 is provided with the surge tank 34*a* and a plurality of intake runners 34*b* branched from the surge tank 34*a* and connected with openings of intake ports 14 (see FIG. 2) formed inside of the engine body 1. The air guided to the surge tank 34*a* is evenly distributed through the intake runners 34*b* and intake ports 14 to the insides of the combustion chambers 11. In this way, the intake pipe 31, intake manifold 34, and intake ports 14 form an intake passage for guiding air to the insides of the combustion chambers 11. At the surge tank 34*a*, a pressure sensor 213 for detecting the pressure inside the surge tank 34*a* (intake pressure) and a temperature sensor 214 for detecting the temperature inside the surge tank 34*a* (intake temperature) are attached.

The throttle valve 35 is provided inside the intake pipe 31 between the intercooler 33 and the surge tank 34*a*. The throttle valve 35 is driven by a throttle actuator 35*a* and makes the passage cross-sectional area of the intake pipe 31 change continuously or in stages. By using the throttle actuator 35*a* to adjust the opening degree of the throttle valve 35, it is possible to adjust the amount of flow of air taken into the combustion chambers 11.

The air flow meter 212 is provided at the upstream side from the compressor 32*a* inside the intake pipe 31. The air flow meter 212 detects the amount of flow of air flowing through the intake passage and finally taken into the combustion chambers 11 (below, referred to as the "intake air amount").

The EGR passage 36 is a passage which connects the later explained exhaust manifold 40 and the surge tank 34*a* of the intake manifold 34 and returns part of the exhaust discharged from the combustion chambers 11 to the surge tank 34*a* using the pressure difference. Below, the exhaust introduced into the EGR passage 36 will be called the "EGR gas" and the ratio of the amount of EGR gas in the amount of gas in the cylinders, that is, the rate of recirculation of the exhaust, will be called the "EGR rate". By making the EGR gas be recirculated to the surge tank 34*a* and in turn the combustion chambers 11, it is possible to reduce the combustion temperature and keep down the discharge of nitrogen oxides ($NO_X$).

The EGR cooler 37 is provided at the EGR passage 36. The EGR cooler 37 is a heat exchanger for cooling the EGR gas by, for example, running wind, cooling water, etc.

The EGR valve 38 is provided at the downstream side in the flow direction of the EGR gas from the EGR cooler 37 in the EGR passage 36. The EGR valve 38 is a solenoid valve able to be adjusted in opening degree continuously or in stages. The opening degree is controlled by the electronic control unit 200. By controlling the opening degree of the EGR valve 38, the flow rate of the EGR gas recirculated to the surge tank 34*a* is adjusted. That is, by controlling the opening degree of the FOR valve 38 to a suitable opening degree in accordance with the intake air amount or intake pressure (supercharging pressure) etc., it is possible to control the EGR rate to any value.

The exhaust system 4 is a system for purifying the exhaust generated inside the combustion chambers and discharging it to the outside air and is provided with the exhaust manifold 40, exhaust pipe 41, turbine 32*b* of the turbocharger 32, and exhaust after-treatment device 42.

The exhaust manifold 40 is provided with a plurality of exhaust runners which are connected to openings of exhaust ports 15 (see FIG. 2) formed inside the engine body 1 and a header which collects the exhaust runners and merges them into one.

The exhaust pipe 41 is connected at one end to a header of the exhaust manifold 40 and is open at the other end. The exhaust discharged from the combustion chambers 11 through the exhaust ports to the exhaust manifold 40 flows through the exhaust pipe 41 and is discharged to the outside air.

The turbine 32*b* is a part forming a portion of the turbocharger 32 and is provided at the exhaust pipe 41. The turbine 32*b* is turned by energy of the exhaust and drives the coaxially provided compressor 32*a*.

At the outside of the turbine 32*b*, a variable nozzle 32*c* is provided. The variable nozzle 32*c* functions as a throttle valve. The nozzle opening degree of the variable nozzle 32*c* (valve opening degree) is controlled by the electronic control unit 200. By changing the nozzle opening degree of the variable nozzle 32*c*, it is possible to change the flow rate of the exhaust driving the turbine 32*b*. That is, by changing the nozzle opening degree of the variable nozzle 32*c*, it is possible to change the rotational speed of the turbine 32*b* and change the supercharging pressure. Specifically, if making the nozzle opening degree of the variable nozzle 32*c* smaller (throttling the variable nozzle 32*c*), the flow rate of the exhaust will rise and the rotational speed of the turbine 32*b* will increase resulting in an increase of the supercharging pressure.

The exhaust after-treatment device 42 is provided at the downstream side from the turbine 32*b* in the exhaust pipe 41. The exhaust after-treatment device 42 is a device for purifying the exhaust and then discharging it to the outside air and contains various types of catalysts for removing harmful substances (for example, a three-way catalyst) carried on a support.

The intake valve operating system 5 is a system for driving operation of the intake valves 50 of the cylinders 10 and is provided at the engine body 1. The intake valve operating system 5 according to the present embodiment is configured to enable control of the operating timings of the intake valves 50, for example, to drive operation of the intake valves 50 by electromagnetic actuators.

The exhaust valve operating system 6 is a system for driving operation of the exhaust valves 60 of the cylinders 10 and is provided at the engine body 1. The exhaust valve operating system 6 according to the present embodiment is configured to enable control of the operating timings of the exhaust valves 60, for example, to drive operation of the exhaust valves by electromagnetic actuators.

Note that, the intake valve operating system 5 and exhaust valve operating system 6 are not limited to electromagnetic actuators. For example, it is also possible to use a camshaft to drive the operation of the intake valves 50 or exhaust valves 60 and provide at one end of the camshaft a variable valve operation mechanism changing the relative phase angle of the camshaft to the crankshaft by hydraulic control to thereby enable control of the operating timings of the intake valves 50 or exhaust valves 60.

The electronic control unit 200 is comprised of a digital computer having components connected with each other by a bidirectional bus 201 such as a ROM (read only memory) 202, RAM (random access memory) 203, CPU (microprocessor) 204, input port 205, and output port 206.

At the input port 205, output signals of the above-mentioned fuel pressure sensor 211 etc. are input through corresponding AD converters 207. Further, at the input port 205, the output voltage of a load sensor 221 generating an output voltage proportional to the amount of depression of an accelerator pedal 220 (below, referred to as the "amount of accelerator depression" is input as a signal for detection of the engine load through a corresponding AD converter 207. Further, at the input port 205, as signals for calculating the engine rotational speed etc., the output signal of the crank angle sensor 222 generating an output pulse every time the crankshaft of the engine body 1 rotates by for example 15° is input. In this way, at the input port 205, output signals of various sensors required for control of the internal combustion engine 100 are input.

The output port 206 is connected through corresponding drive circuits 208 to the fuel injectors 20 and other controlled parts.

The electronic control unit 200 outputs control signals for controlling the different controlled parts from the output port 206 based on the output signals of various sensors input to the input port 205 so as to control the internal combustion engine 100. Below, the control of the internal combustion engine 100 which the electronic control unit 200 performs, in particular the combustion control of the fuel inside of the combustion chambers 11, will be explained.

Figure 3:
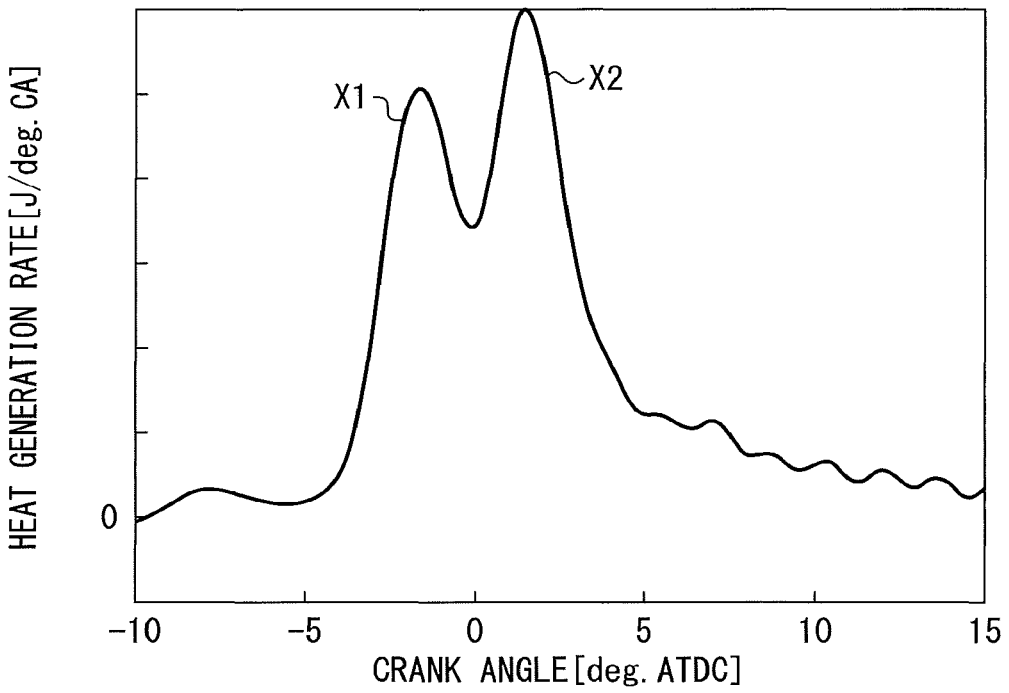
FIG. 3 is a view showing a relationship between a crank angle and heat generation rate if performing combustion control according to one embodiment of the present disclosure to make fuel burn in a combustion chamber.
Figure 4:
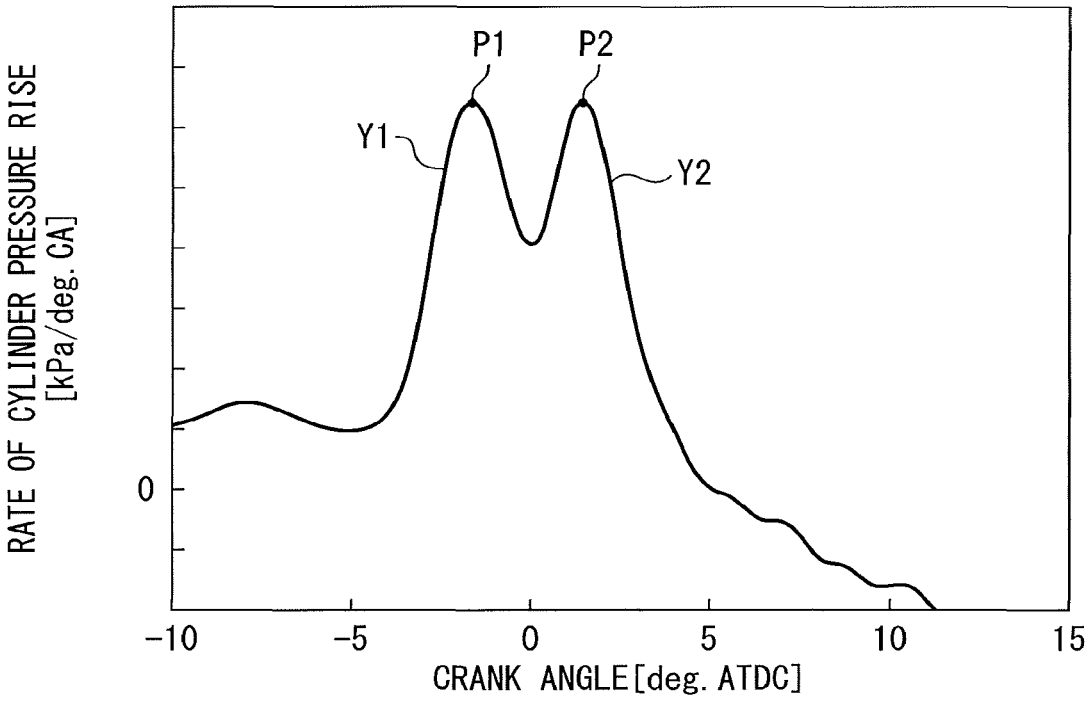
FIG. 4 is a view showing a relationship between a crank angle and rate of cylinder pressure rise if performing combustion control according to one embodiment of the present disclosure to make fuel burn in a combustion chamber.

FIG. 3 is a view showing the relationship between the crank angle and heat generation rate in the case of performing the combustion control according to the present embodiment to make fuel burn in a combustion chamber 11 at the time when the engine operating state (engine rotational speed and engine load) is a certain steady state operation. Further, FIG. 4 is a view showing the relationship between the crank angle and the rate of cylinder pressure rise in this case.

Note that the "heat generation rate (dQ/dθ) [J/deg·CA]" is the amount of heat per unit crank angle generated when making fuel burn, that is, the amount Q of heat generated per unit crank angle. In the following explanation, the combustion waveform showing this relationship between the crank angle and heat generation rate, that is, the combustion waveform showing the change over time of the heat generation rate, will be called the "heat generation rate pattern". Further, the "rate of cylinder pressure rise (dP/dθ) [kPa/deg·CA]" is the crank angle differential of the cylinder pressure P [kPa]. In the following explanation, the pressure waveform showing this relationship between the crank angle and the rate of cylinder pressure rise, that is, the pressure waveform showing the change over time of the rate of cylinder pressure rise, will be called the "cylinder pressure rise pattern".

The electronic control unit 200 successively performs a main fuel injection performed for outputting the required torque corresponding to the engine load split between a first main fuel injection G1 and a second main fuel injection G2 so as to operate the engine body 1.

At this time, in the present embodiment, so as to cause premix charged compression ignition where the fuel injected by the first main fuel injection G1 into the combustion chamber 11 (below, referred to as the "first main fuel") and the fuel injected by the second main fuel injection G2 into the combustion chamber 11 (below, referred to as the "second main fuel") are burned after a certain extent of premix time with the air after fuel injection, the injection amounts and injection timing of the fuel injections G1, G2 are controlled so that heat is generated two times in stages.

That is, as shown in FIG. 3, to enable a first peak of a combustion waveform X1 of the heat generation rate pattern to be formed by generation of heat mainly when the first main fuel is burned and then a second peak of a combustion waveform X2 of the heat generation rate pattern to be formed by generation of heat mainly when the second main fuel is burned, the injection amounts and injection timings of the fuel injections G1, G2 are controlled so that the heat generation rate pattern becomes a two-peak shape.

Further, due to this, as shown in FIG. 4, a first peak of a pressure waveform Y1 of the cylinder pressure rise pattern is formed by generation of heat mainly when the first main fuel is burned and then a second peak of a pressure waveform Y2 of the cylinder pressure rise pattern is formed by generation of heat mainly when the second main fuel is burned whereby the cylinder pressure rise pattern also becomes a two-peak shape along with the heat generation rate pattern.

By causing heat to be generated two times in stages with a suitable time between them in this way, it is possible to shift the phase of the pressure wave produced by the second heat generation (in the present embodiment, the pressure wave arising mainly when the second main fuel is burned) with respect to the phase of the pressure wave produced by the first heat generation (in the present embodiment, the pressure wave arising mainly when the first main fuel is burned). For this reason, for example, it is possible to make the phase of the second pressure wave an inverse phase to the phase of the first or otherwise suitably shift the phases of the two pressure waves to thereby reduce the amplitude of the actual pressure wave causing combustion noise generated due to the superposition of these two pressure waves.

Further, the magnitude of the amplitude of the pressure wave arising due to the first heat generation is in a proportional relationship with the magnitude of the peak value P1 of the first peak of the pressure waveform Y1 of the cylinder pressure rise pattern (below, referred to as the "first peak value"). Similarly, the magnitude of the amplitude of the pressure wave arising due to the second heat generation is in a proportional relationship with the magnitude of the peak value P2 of the second peak of the pressure waveform Y2 of the cylinder pressure rise pattern (below, referred to as the "second peak value"). Therefore, when the magnitudes of the first peak value P1 and the second peak value P2 are the same (that is, when P1:P2=1:1), the effect of reduction of combustion noise becomes the greatest.

Therefore, in the present embodiment, as shown in FIG. 4, the injection amounts and injection timings of the fuel injections G1, G2 are controlled so that the magnitudes of the first peak value P1 and the second peak value P2 become substantially the same, specifically, the value PR of the ratio of the first peak value P1 and the second peak value P2 (=P1/P2; below, referred to as the "peak ratio") falls within a predetermined range (for example, 0.9 to 1.1 in range). Due to this, it is possible to effectively suppress combustion noise when performing premix charged compressive ignition to operate the engine body 1.

In this way, the electronic control unit 200 according to the present embodiment controls the target injection amounts Q1, Q2 and the target injection timings A1, A2 of the fuel injections G1, G2 to target values set in advance by experiments etc. based on the engine operating state so that the cylinder pressure rise rate pattern when performing premix charged compression ignition becomes the desired shape (shape of two peaks with peak ratio PR within predetermined range). Note that in the following explanation, the target injection amount Q1 and the target injection timing A1 of the first main fuel injection G1 will be referred to respectively as the "first target injection amount Q1" and the "first target injection timing A1" according to need. Further, the target injection amount Q2 and the target injection timing A2 of the second main fuel injection G2 will if necessary be referred to respectively as the second target injection amount Q2 and the first target injection timing A2.

In this regard, during engine operation, sometimes correction values are set for these target values. As one of these, the correction amount "q" for the amount of fuel injected from the fuel injector 20 (target injection amount) (below, referred to as the "injection correction amount") may be mentioned. For example, there are a correction amount among cylinders, a correction amount for dampening vibration of a vehicle, etc.

The correction amount among cylinders is a correction amount set so as to suppress variation which sometimes occurs in the amount of fuel actually injected from the different fuel injectors 20, due to individual variation, aging, and other causes, even if the target injections amounts for the fuel injectors 20 are the same. The correction amount for dampening vibration of a vehicle is a correction amount set so as to suppress vibration of the engine body 1 in the front-rear direction of the vehicle due to the change in output torque of the engine body 1 at the time of acceleration or deceleration of the vehicle.

Here, the target injection amounts Q1, Q2 of the fuel injections G1, G2 are target values set in advance by experiments etc. so that the cylinder pressure rise rate pattern when performing premix charged compression ignition becomes the desired shape. Therefore, when such an injection correction amount "q" is set, if not suitably applying the injection correction amount "q" with respect to the first target injection amount Q1 and the second target injection amount Q2 so that the cylinder pressure rise rate pattern when performing premix charged compression ignition becomes a desired shape, the combustion noise is liable to end up increasing.

That is, if, like in the present embodiment, successively performing the main fuel injection split into the first main fuel injection G1 and the second main fuel injection G2 so that the cylinder pressure rise rate pattern when performing premix charged compression ignition becomes the desired shape, when the injection correction amount "q" is set, how to apply the injection correction amount "q" to the target injection amount Q1 and the target injection amount Q2 becomes the question.

Figure 5:
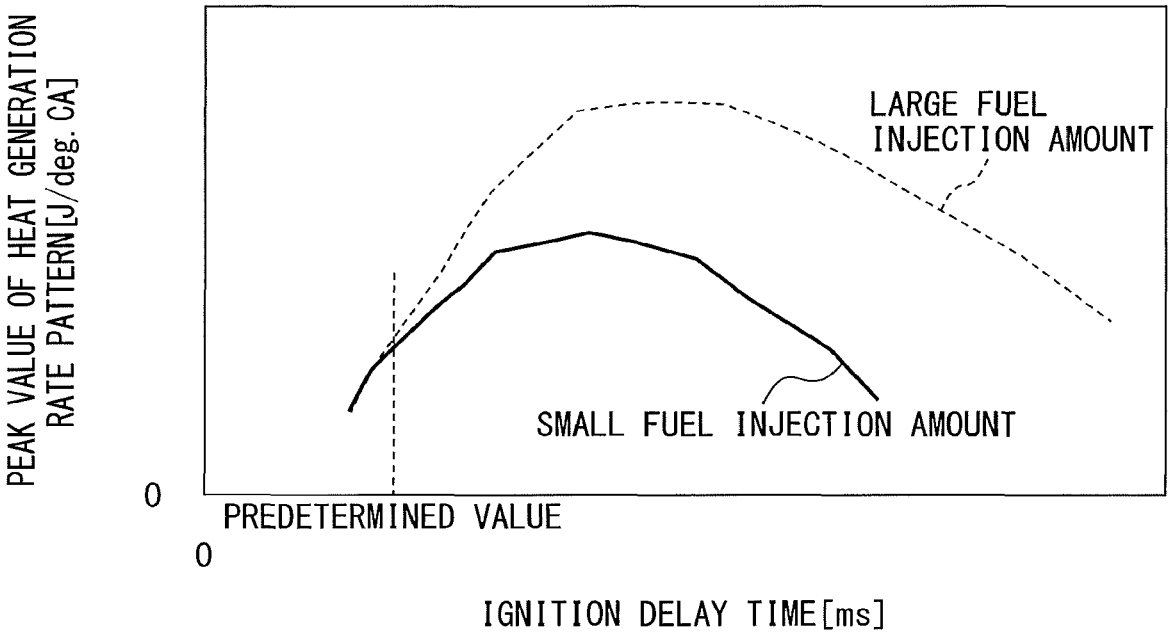
FIG. 5 is a view showing a relationship between a peak value of a heat generation rate pattern and an ignition delay time if injecting fuel from a fuel injector just once to perform premix charged compression ignition by comparing the time when the fuel injection amount is large and when it is small.

FIG. 5 is a view showing a relationship between a peak value of a heat generation rate pattern and an ignition delay time τ (ms) (time until fuel injected into combustion chamber 11 self ignites) if injecting fuel from a fuel injector 20 just once to perform premix charged compression ignition by comparing the time when the fuel injection amount is large and when it is small.

As shown in FIG. 5, if comparing the peak values of the heat generation rate patterns between when the fuel injection amount is large and when it is small, it will be understood that when the ignition delay time τ is shorter than a predetermined value, there is almost no difference in the magnitude of the peak value. Further, it will be understood that as the ignition delay time r becomes longer than a predetermined value, gradually a difference starts to arise in the magnitude of the peak value and the difference becomes greater.

This is believed to be because if the ignition delay time τ when performing premix charged compression ignition becomes shorter, part of the fuel in the fuel injected from the fuel injector 20 will be insufficiently premixed with the air and the fuel will end up being burned in the form of combustion close to diffusive combustion rather than premix charged compression ignition.

Premix charged compression ignition is a form of combustion where fuel is injected, then a certain amount of time is set aside for premixing with air, then the fuel diffused inside the combustion chamber 11 (premix) is made to self ignite at numerous points at the same timing, so compared with diffusive combustion where the fuel injected into a combustion chamber 11 is made to burn substantially without delay after the fuel is injected, the combustion speed becomes faster and the combustion period becomes shorter. For this reason, when performing premix charged compression ignition, the peak value of the heat generation rate pattern tends to become greater than when performing diffusive combustion. Further, the peak value of the heat generation rate pattern basically depends on the amount of fuel in premix charged compression ignition. The greater the amount of fuel, the higher it tends to become.

Therefore, as shown in FIG. 5, when the ignition delay time τ is shorter than a predetermined value, regardless of the magnitude of the fuel injection amount, generally a certain amount of fuel undergoes premix charged compression ignition while the remaining fuel is burned in a state of combustion close to diffusive combustion. It is believed that almost no difference occurs in the magnitude of the peak values of the different heat generation rate patterns. Further, as the ignition delay time τ becomes longer than the predetermined value, the greater the fuel injection amount, the greater the amount of fuel undergoing premix charged compression ignition, so it may be considered that a difference starts to arise in the magnitude of the peak values and that difference becomes larger.

In this way, as a result of intensive research by the inventors, it was learned that if the ignition delay time τ when performing premix charged compression ignition is shorter than a certain predetermined value, even if changing the fuel injection amount, the peak value of the heat generation rate pattern and in turn the peak value of the cylinder pressure rise rate pattern will not change much at all.

Further, if, like in the present embodiment, successively performing the main fuel injection split between a first main fuel injection G1 and a second main fuel injection G2, since the second main fuel injection G2 is performed after the first main fuel injection G1, the ignition delay time τ2 of the second main fuel (below, referred to as the "second ignition delay time") becomes shorter than the ignition delay time τ1 of the first main fuel (below, referred to as the "first ignition delay time").

Therefore, in the present embodiment, if the second ignition delay time τ2 is less than a predetermined value, all of the injection correction amount "q" is applied to the second target injection amount Q2.

Figure 6:
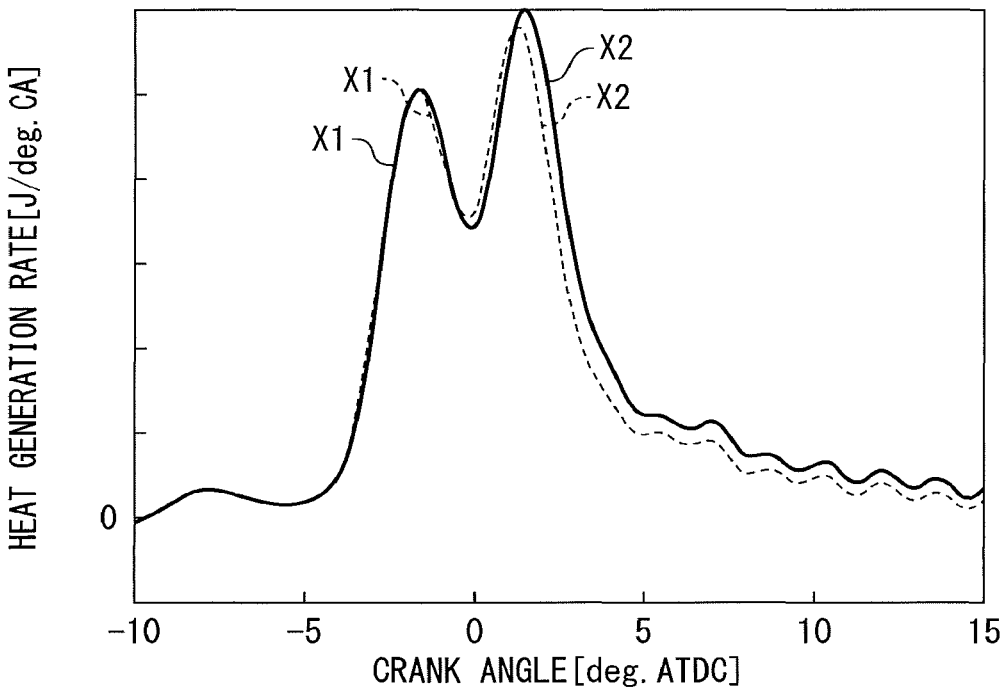
FIG. 6 is a view showing in comparison a heat generation rate pattern when an injection correction amount is not set (solid line) and a heat generation rate pattern if the second ignition delay time is less than a predetermined value and all of the injection correction amount is applied to the second target injection amount (broken line).
Figure 7:
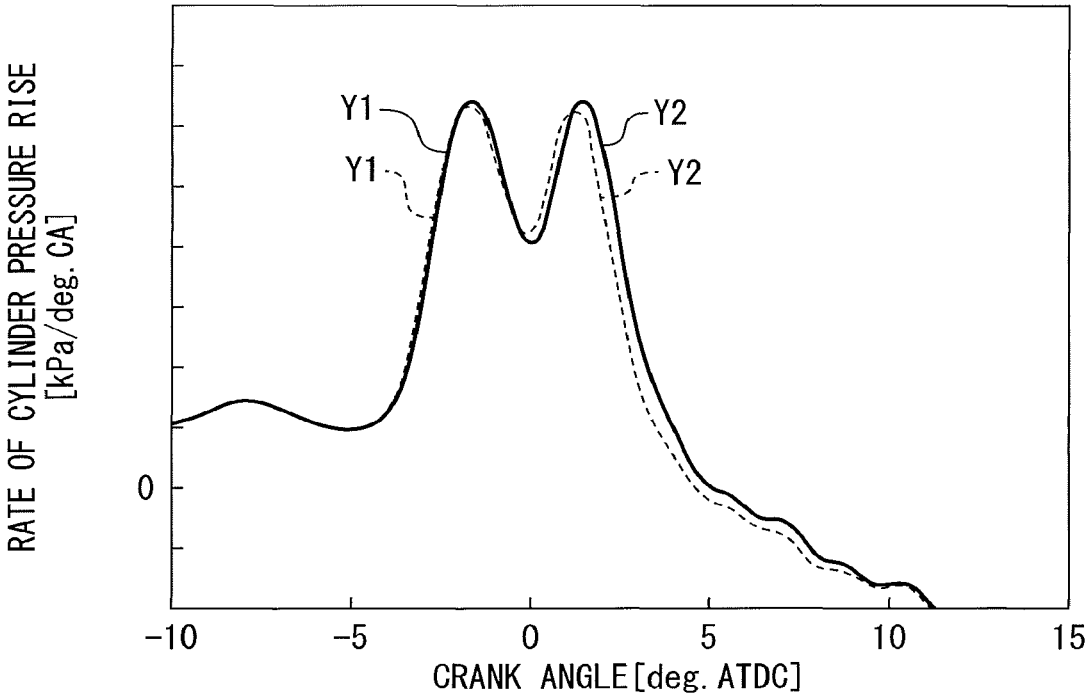
FIG. 7 is a view showing in comparison a cylinder pressure rise rate pattern when an injection correction amount is not set (solid line) and a cylinder pressure rise rate pattern if the second ignition delay time is less than a predetermined value and all of the injection correction amount is applied to the second target injection amount (broken line).

FIG. 6 and FIG. 7 are views showing in comparison a heat generation rate pattern and a cylinder pressure rise rate pattern when an injection correction amount "q" is not set (solid lines) and a heat generation rate pattern and cylinder pressure rise rate pattern if the second ignition delay time τ2 is less than a predetermined value and all of the injection correction amount "q" (in the examples shown in FIG. 6 and FIG. 7, correction value of decreased amount) is applied to the second target injection amount Q2 (broken lines).

As shown by the broken lines in FIG. 6 and FIG. 7, it will be understood that if the second ignition delay time τ2 is less than a predetermined value, by applying all of the injection correction amount "q" to the second target injection amount Q2, the peak value of the second peak of the combustion waveform X2 of the heat generation rate pattern and in turn the second peak value P2 of the cylinder pressure rise rate pattern do not change much at all in magnitude. Therefore, even if the injection correction amount "q" is set, if the second ignition delay time τ2 is less than a predetermined value, it is possible to apply the injection correction amount "q" to the second target injection amount Q2 so as to maintain the shape of the cylinder pressure rise rate pattern when performing premix charged compression ignition at the desired shape.

On the other hand, if the second ignition delay time τ2 is a predetermined value or more, if ending up applying all of the injection correction amount "q" to the second target injection amount Q2, the peak value of the second peak of the combustion waveform X2 of the heat generation rate pattern and in turn the second peak value P2 of the cylinder pressure rise rate pattern will end up changing. Therefore, if the second ignition delay time τ2 is a predetermined value or more, it is necessary to suitably allocate the injection correction amount "q" to the first target injection amount Q1 and the second target injection amount Q2 so that the shape of the cylinder pressure rise rate pattern when performing premix charged compression ignition is maintained at a desired shape.

Figure 8:
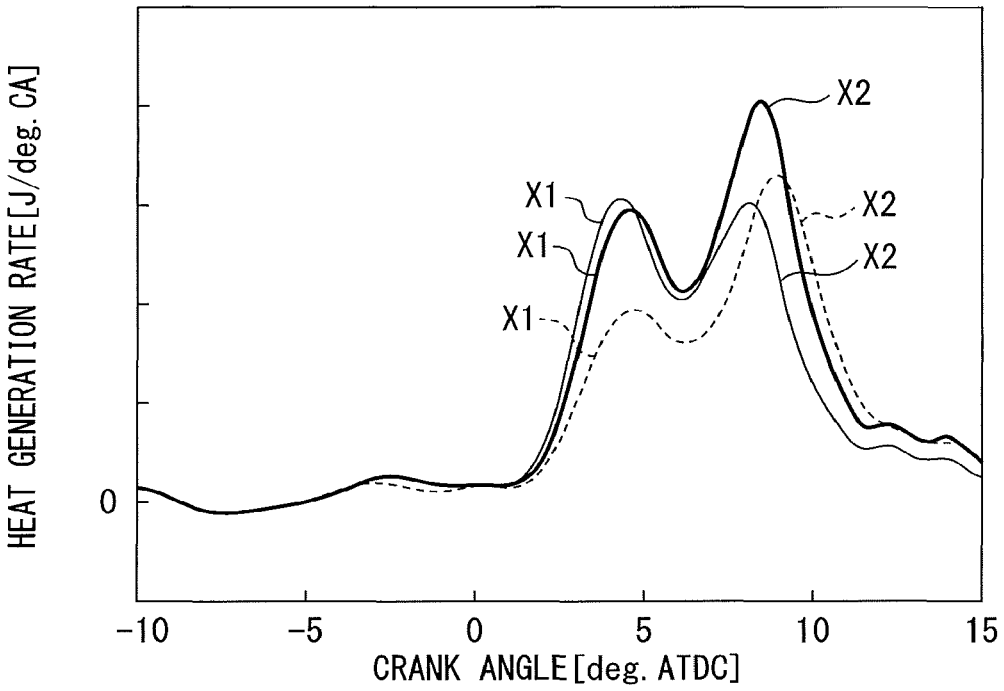
FIG. 8 is a view showing in comparison a heat generation rate pattern when an injection correction amount is not set (thick solid line), a heat generation rate pattern when a second ignition delay time is a predetermined value or more and when all of the injection correction amount is applied to the second target injection amount (fine solid line), and a heat generation rate pattern when the second ignition delay time is a predetermined value or more and when the injection correction amount is applied equally allocated to the first target injection amount and the second target injection amount (broken line).
Figure 9:
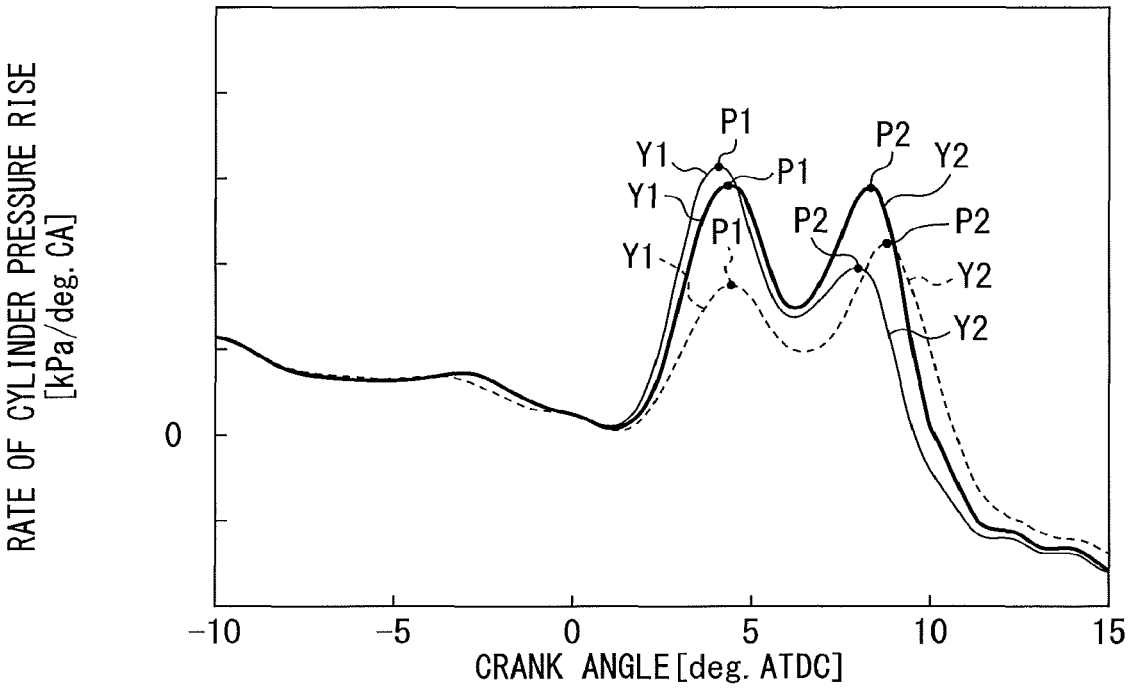
FIG. 9 is a view showing in comparison a cylinder pressure rise rate pattern when an injection correction amount is not set (thick solid line), a cylinder pressure rise rate pattern when a second ignition delay time is a predetermined value or more and when all of the injection correction amount is applied to the second target injection amount (fine solid line), and a cylinder pressure rise rate pattern when the second ignition delay time is a predetermined value or more and when the injection correction amount is applied equally allocated to the first target injection amount and the second target injection amount (broken line).

FIG. 8 and FIG. 9 are views showing in comparison a heat generation rate pattern and a cylinder pressure rise rate pattern when an injection correction amount "q" is not set (thick solid lines), a heat generation rate pattern and cylinder pressure rise rate pattern if the second ignition delay time τ2 is a predetermined value or more and all of the injection correction amount "q" (in the examples shown in FIG. 8 and FIG. 9, correction value of decreased amount) is applied to the second target injection amount Q2 (fine solid lines), and a heat generation rate pattern and cylinder pressure rise rate pattern if the second ignition delay time τ2 is a predetermined value or more and the injection correction amount "q" is applied evenly allocated to the first target injection amount Q1 and the second target injection amount Q2 (broken lines).

As shown by the fine solid lines in FIG. 8 and FIG. 9, if the second ignition delay time τ2 is a predetermined value or more, if applying all of the injection correction amount "q" to the second target injection amount Q2, when the injection correction amount "q" is a correction value for a decrease, the peak value of the second peak of the combustion waveform X2 of the heat generation rate pattern greatly falls and the second peak value P2 of the cylinder pressure rise rate pattern ends up greatly falling. As a result, it is no longer possible to maintain the shape of the cylinder pressure rise rate pattern when performing premix charged compression ignition at the desired shape.

For this reason, for example, it may be considered to apply the injection correction amount "q" evenly allocated to the first target injection amount Q1 and the second target injection amount Q2.

However, as explained above, the second main fuel injection G2 is performed after the first main fuel injection G1, so the second ignition delay time τ2 becomes shorter than the first ignition delay time τ1 (conversely speaking the first ignition delay time τ1 becomes longer than the second ignition delay time τ2).

For this reason, as shown in FIG. 8 by the broken line, if applying the injection correction amount "q" evenly allocated to the first target injection amount Q1 and the second target injection amount Q2, the peak value of the first peak of the combustion waveform X1 will end up excessively changing compared with the peak value of the second peak of the combustion waveform X2 of the heat generation rate pattern. Therefore, as shown in FIG. 8 and FIG. 9 by the broken lines, when the injection correction amount "q" is a correction value for a decrease, the peak value of the first peak of the combustion waveform X1 will end up greatly falling compared with the peak value of the second peak of the combustion waveform X2 of the heat generation rate pattern and the first peak value P1 of the cylinder pressure rise rate pattern will end up becoming much smaller than the second peak value P2.

Therefore, if the second ignition delay time τ2 is a predetermined value or more, it is necessary to suitably allocate the injection correction amount "q" to the target injection amount Q1 and the target injection amount Q2 based on the respective lengths of the first ignition delay time τ1 and the second ignition delay time τ2.

Therefore, in the present embodiment, if designating the part of the injection correction amount "q" to be allocated to the first target injection amount as the "first allocation amount q1" and the part to be allocated to the second target injection amount as the "second allocation amount q2", if the ignition delay time t2 of the second main fuel is a predetermined value or more, the injection correction amount "q" is designed to be allocated to the first target injection amount Q1 and the second target injection amount Q2 so that the ratio of the first allocation amount q1 and the second allocation amount q2 becomes the reciprocal of the ratio of the first ignition delay time τ1 and the second ignition delay time τ2, that is, so that q1:q2=1/τ1:1/τ2(=τ2:τ1).

Due to this, it is possible to suitably adjust the allocation amounts q1, q2 based on the respective lengths of the first ignition delay time τ1 and the second ignition delay time τ2 so that the second allocation amount q2 allocated to the target injection amount Q2 of the second main fuel injection G2 with the shorter ignition delay time τ becomes greater than the first allocation amount q1 allocated to the target injection amount Q1 of the first main fuel injection G1 with the longer ignition delay time. For this reason, it is possible to adjust the changes in the first peak value P1 and the second peak value P2 of the cylinder pressure rise rate pattern to substantially the same extents, so it is possible to maintain the shape of the cylinder pressure rise rate pattern when performing premix charged compression ignition at a desired shape.

Figure 10:
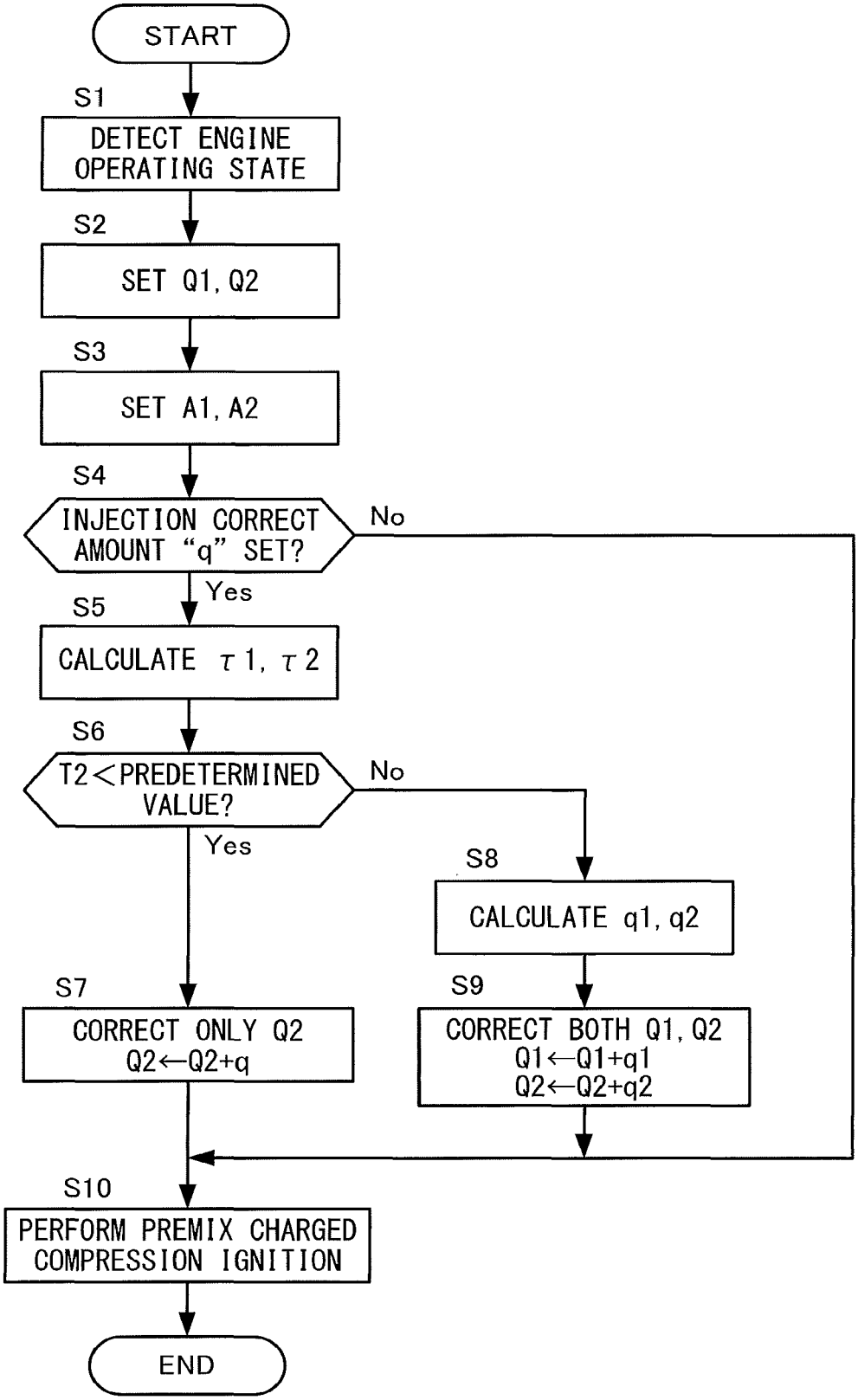
FIG. 10 is a flow chart for explaining combustion control according to one embodiment of the present disclosure.

FIG. 10 is a flow chart for explaining combustion control according to the present embodiment. The electronic control unit 200 repeatedly performs the present routine during engine operation at predetermined processing periods.

At step S1, the electronic control unit 200 reads in the engine rotational speed calculated based on the output signal of the crank angle sensor 222 and the engine load detected by the load sensor 221 and detects the engine operating state.

At step S2, the electronic control unit 200 sets the target injection amount Q1 of the first main fuel injection G1 and the target injection amount Q2 of the second main fuel injection G2. In the present embodiment, the electronic control unit 200 refers to a table prepared in advance by experiments etc. and sets the target injection amount Q1 and the target injection amount Q2 based on at least the engine load.

At step S3, the electronic control unit 200 sets the target injection timing A1 of the first main fuel injection G1 and the target injection timing A2 of the second main fuel injection G2. In the present embodiment, the electronic control unit 200 refers to a table prepared in advance by experiments etc. and sets the target injection timing A1 and the target injection timing A2 based on the engine operating state.

At step S4, the electronic control unit 200 judges if the injection correction amount "q" has been set. Specifically, the electronic control unit 200 reads in the value of the injection correction amount "q" calculated separately from the present routine at any time during engine operation and if the value of the injection correction amount "q" is other than zero, judges that the injection correction amount "q" has been set and proceeds to the processing of step S5. On the other hand, if the value of the injection correction amount "q" is zero, the electronic control unit 200 judges that the injection correction amount "q" has not been set and proceeds to the processing of step S10.

At step S5, the electronic control unit 200 estimates the first ignition delay time it and the second ignition delay time τ2. In the present embodiment, the electronic control unit 200 uses a predictive model of the ignition delay time τ (for example predictive model utilizing Livengood-Wu integral etc.) to estimate the first ignition delay time τ1 and the second ignition delay time τ2 based on the intake air amount or intake pressure, the intake temperature, the FGR rate (oxygen density), and other states of the cylinder environment.

At step S6, the electronic control unit 200 judges if the second ignition delay time τ2 is less than a predetermined value. The electronic control unit 200 proceeds to the processing of step S7 if the second ignition delay time τ2 is less than a predetermined value. On the other hand, the electronic control unit 200 proceeds to the processing of step S8 if the second ignition delay time τ2 is the predetermined value or more.

At step S7, the electronic control unit 200 applies all of the injection correction amount "q" to the second target injection amount Q2 to correct only the second target injection amount Q2.

At step S8, the electronic control unit 200 calculates the first allocation amount q1 and the second allocation amount q2 based on the first ignition delay time it and the second ignition delay time τ2. In the present embodiment, the electronic control unit 200 splits the injection correction amount "q" between the first allocation amount q1 and the second allocation amount q2 so that the ratio of the first allocation amount q1 and the second allocation amount q2 becomes a reciprocal of the ratio between the first ignition delay time τ1 and the second ignition delay time τ2.

At step S9, the electronic control unit 200 applies the first allocation amount q1 to the first target injection amount Q1 and applies the second allocation amount q2 to the second target injection amount Q2 to correct both of the first target injection amount Q1 and the second target injection amount Q2.

At step S10, the electronic control unit 200 controls the injection amount and injection timing of the first main fuel injection G1 to their respective first target injection amount Q1 and first target injection timing A1 and controls the injection amount and injection timing of the second main fuel injection G2 to their respective second target injection amount Q2 and first target injection timing A2 to perform the premix charged compression ignition.

According to the embodiment explained above, there is provided an electronic control unit 200 (control device) for controlling an internal combustion engine 100 provided with an engine body 1 and a fuel injector 20 injecting fuel for burning in a combustion chamber 11 of the engine body 1. The electronic control unit 200 is provided with a combustion control part successively performing at least first main fuel injection G1 and second main fuel injection G2 to cause premix charged compression ignition of the fuel so as to cause heat generation two times in stages inside the combustion chamber 11 so that a pressure waveform showing a change of a rate of cylinder pressure rise over time becomes a two-peak shape and so that a peak ratio PR of a ratio of a first peak value P1 of a first peak of the pressure waveform formed by a first heat generation and a second peak value P2 of a second peak of the pressure waveform formed by a second heat generation falls within a predetermined range.

Further, the combustion control part is provided with a second ignition delay time calculating part for calculating a second ignition delay time τ2 of an estimated value of an ignition delay time τ of fuel injected by the second main fuel injection G2 and is configured so that when the injection correction amount "q" is set for the amount of fuel injected from the fuel injector 20, if the second ignition delay time τ2 is less than a predetermined value, it applies the injection correction amount "q" to the second target injection amount Q2 of the target injection amount of the second main fuel injection G2.

When the second ignition delay time is less than a predetermined value, the premixing time period of the fuel injected by the second main fuel injection G2 and the air is short and the fuel able to be ignited by premix charged compression ignition is limited, so by reflecting the injection correction amount "q" in the second target injection amount Q2, the peak value of the second peak of the combustion waveform X2 of the heat generation rate pattern and in turn the second peak value P2 of the cylinder pressure rise rate pattern do not change much at all in magnitude. For this reason, it is possible to maintain the shape of the cylinder pressure rise rate pattern when performing premix charged compression ignition at the desired shape and possible to keep the combustion noise from becoming worse.

Further, if an injection correction amount "q" is set for the amount of fuel injected from the fuel injector 20, when the second ignition delay time τ2 is a predetermined value or more, the combustion control part according to the present embodiment is configured to apply the injection correction amount "q" allocated to the first target injection amount Q1 of the target injection amount of the first main fuel injection G1 and the second target injection amount Q2 and to make the second allocation amount q2 allocated to the second target injection amount Q2 in the injection correction amount "q" larger than the first allocation amount q1 allocated to the first target injection amount Q1.

Specifically, the combustion control part is further provided with a first ignition delay time calculating part calculating a first ignition delay time τ1 of an estimated value of the ignition delay time of the fuel injected by the first main fuel injection G1. It is configured so as to allocate the injection correction amount "q" to the first target injection amount Q1 and the second target injection amount Q2 so that when the second ignition delay time τ2 is a predetermined value or more, the ratio of the first allocation amount q1 in the injection correction amount "q" allocated to the first target injection amount Q1 and the second allocation amount q2 allocated to the second target injection amount Q2 becomes a reciprocal of the ratio of the first ignition delay time τ1 and the second ignition delay time τ2.

Due to this, it is possible to suitably adjust the allocation amounts q1, q2 based on the lengths of the first ignition delay time τ1 and the second ignition delay time τ2 so that the second allocation amount q2 allocated to the target injection amount Q2 of the second main fuel injection G2 with the short ignition delay time becomes larger than the first allocation amount q1 allocated to the target injection amount Q1 of the first main fuel injection G1 with the long ignition delay time. For this reason, it is possible to adjust the changes in the first peak value P1 and the second peak value P2 of the cylinder pressure rise rate pattern to substantially the same extents, so it is possible to maintain the shape of the cylinder pressure rise rate pattern when performing premix charged compression ignition at a desired shape and possible to keep combustion noise from worsening.

Above, an embodiment of the present disclosure was explained, but the above embodiment only shows part of the examples of application of the present disclosure and is not meant to limit the technical scope of the present disclosure to the specific constitutions of the embodiment.

For example, in the above embodiment, in addition to the first main fuel injection G1 and the second main fuel injection G2, it is possible to perform pilot injection or pre-injection or other injection of fuel other than the main fuel injection.

The invention claimed is:

1. A control device for an internal combustion engine, the internal combustion engine comprising an engine body and a fuel injector injecting fuel for combustion inside a combustion chamber of the engine body, wherein the control device comprises a combustion control part configured to successively perform at least first main fuel injection and second main fuel injection to cause premix charged compression ignition of the fuel so as to cause heat generation two times in stages inside the combustion chamber so that a pressure waveform showing a change of a rate of cylinder pressure rise over time becomes a two-peak shape and so that a peak ratio which is a ratio of a first peak value of a first peak of the pressure waveform formed by a first heat generation and a second peak value of a second peak of the pressure waveform formed by a second heat generation falls within a predetermined range, and the combustion control part comprises a second ignition delay time calculating part configured to calculate a second ignition delay time which is an estimated value of an ignition delay time of fuel injected by the second main fuel injection, and the combustion control part is configured so that if an injection correction amount for an amount of fuel injected from the fuel injector is set, when the second ignition delay time is less than a predetermined value, the injection correction amount is applied to a second target injection amount which is a target injection amount of the second main fuel injection.

2. The control device for the internal combustion engine according to claim 1, wherein the combustion control part is configured so that if the injection correction amount is set, when the second ignition delay time is a predetermined value or more, the injection correction amount is applied allocated to a first target injection amount which is a target injection amount of the first main fuel injection and the second target injection amount and so that a second allocation amount allocated to the second target injection amount in the injection correction amount is made greater than a first allocation amount allocated to the first target injection amount.

3. The control device for the internal combustion engine according to claim 1, wherein the combustion control part further comprises a first ignition delay time calculating part configured to calculate a first ignition delay time which is an estimated value of an ignition delay time of fuel injected by the first main fuel injection, and the combustion control part is configured to allocate the injection correction amount separately to a first target injection amount and the second target injection amount so that a ratio of a first allocation amount allocated to the first target injection amount which is the target injection amount of the first main fuel injection and a second allocation amount allocated to the second target injection amount in the injection correction amount becomes a reciprocal of a ratio of the first ignition delay time and the second ignition delay time if the injection correction amount is set and when the second ignition delay time is the predetermined value or more.

* * * * *